US005360204A

United States Patent [19]

Mancuso

[11] Patent Number: 5,360,204

[45] Date of Patent: Nov. 1, 1994

[54] BOOM AND LANCE FOR REMOVING SLAG FROM CRUCIBLE

[75] Inventor: Matthew A. Mancuso, New Kensington, Pa.

[73] Assignee: Keibler-Thompson Corp., New Kensington, Pa.

[21] Appl. No.: 123,894

[22] Filed: Sep. 20, 1993

[51] Int. Cl.[5] ..... C21B 3/04

[52] U.S. Cl. ..... 266/226; 75/582; 266/228

[58] Field of Search ..... 75/582; 266/228, 225, 266/226

[56] References Cited

U.S. PATENT DOCUMENTS 3,761,242 9/1973 Finkl .
4,517,015 5/1985 Inaba et al. .

FOREIGN PATENT DOCUMENTS 3742170 3/1989 Germany ..... 75/582
185719 10/1984 Japan ..... 75/582

*Primary Examiner*—Melvyn J. Andrews
*Attorney, Agent, or Firm*—Andrew Alexander

[57] ABSTRACT

Disclosed is a method of removing slag from a body of molten iron comprising the steps of providing a body of molten iron in a crucible, the body having a layer of slag on the surface thereof, the crucible having a side thereof for removing slag therefrom. Means is provided for removing the slag at the side from the surface of the molten iron. Gas is injected into the molten iron to concentrate the slag on the surface adjacent the side for removing the slag to facilitate removal thereof. The concentrated slag is removed over the side by the means for removing the slag.

1 Claim, 2 Drawing Sheets

BOOM AND LANCE FOR REMOVING SLAG FROM CRUCIBLE

BACKGROUND OF THE INVENTION

This invention relates to removal of slag from molten metal, and more particularly, it relates to a method and apparatus highly efficient in the removal of slag from the surface of a body of molten metal.

In the prior art it is known to remove slag from the surface of molten metal by raking. However, this approach is not without its problems. That is, when a rake is used to pull slag from the surface of a body of molten metal, the operation does not discriminate, and often a large amount of molten metal is removed with the slag which interferes with the efficiency of the process. The raking approach is inefficient in yet another way. That is, the raking operation can leave as much as 15 to 25% of the slag behind and thus is not very efficient in making a separation of slag from molten metal. Thus, there can occur a high level of undesirable inclusion in cast metal resulting from this practice. It is important to reduce the level of slag on the surface of the molten metal to avoid poring metal therethrough or therewith which contributes to dirty steel.

U.S. Pat. No. 3,761,242 discloses the use of a porous plug mounted in the bottom of a crucible near or adjacent a tap hole, and purging gas is introduced through a porous plug. According to the patent, the purging gas speeds the refining process and pushes the slag away from the tap hole or discharge spout to permit pouring of molten metal. However, in this operation, the slag still remains in the crucible and often it is difficult to remove all the molten metals without removing slag. Alternatively, to avoid removing slag, some molten metal is often left in the crucible. This approach has another disadvantage or problem. That is, the porous plug involves a safety issue, if the porous plug becomes dislodged, and molten metal would draw uncontrollably from the crucible. Further, another safety problem arises when the plug has to be replaced. Thus, the plug can result in a weak point in the crucible.

U.S. Pat. No. 4,517,015 discloses the introduction of gas through a porous plug in the bottom of the crucible and the introduction of gas through a lance projecting through a layer of slag. According to the patent, this produces a duplex stirring effect that produces stirring in a dead zone D, and this shortens the time length required for stirring during the suspension of the electric power supply.

From the above, it will be seen that there is a great need for a method and apparatus that permits the removal of slag from molten metal in a highly efficient and safe manner. The present invention provides such a method and apparatus.

SUMMARY OF THE INVENTION

It is an object of the invention to provide an improved method and apparatus for removing slag from molten metal.

It is another object of the invention to provide an improved method for safely and efficiently removing more than 95% and typically more than 98% of the slag layer from the surface of molten metal contained in a crucible.

Yet, it is another object of the invention to provide a method of concentrating the slag in a slag layer in a position on the surface of molten metal body that facilitates its removal therefrom.

These and other objects will become apparent from the drawings, specification and claims appended hereto.

DETAILED DESCRIPTION OF THE PREFERRED EMBODIMENTS

Figure 1:
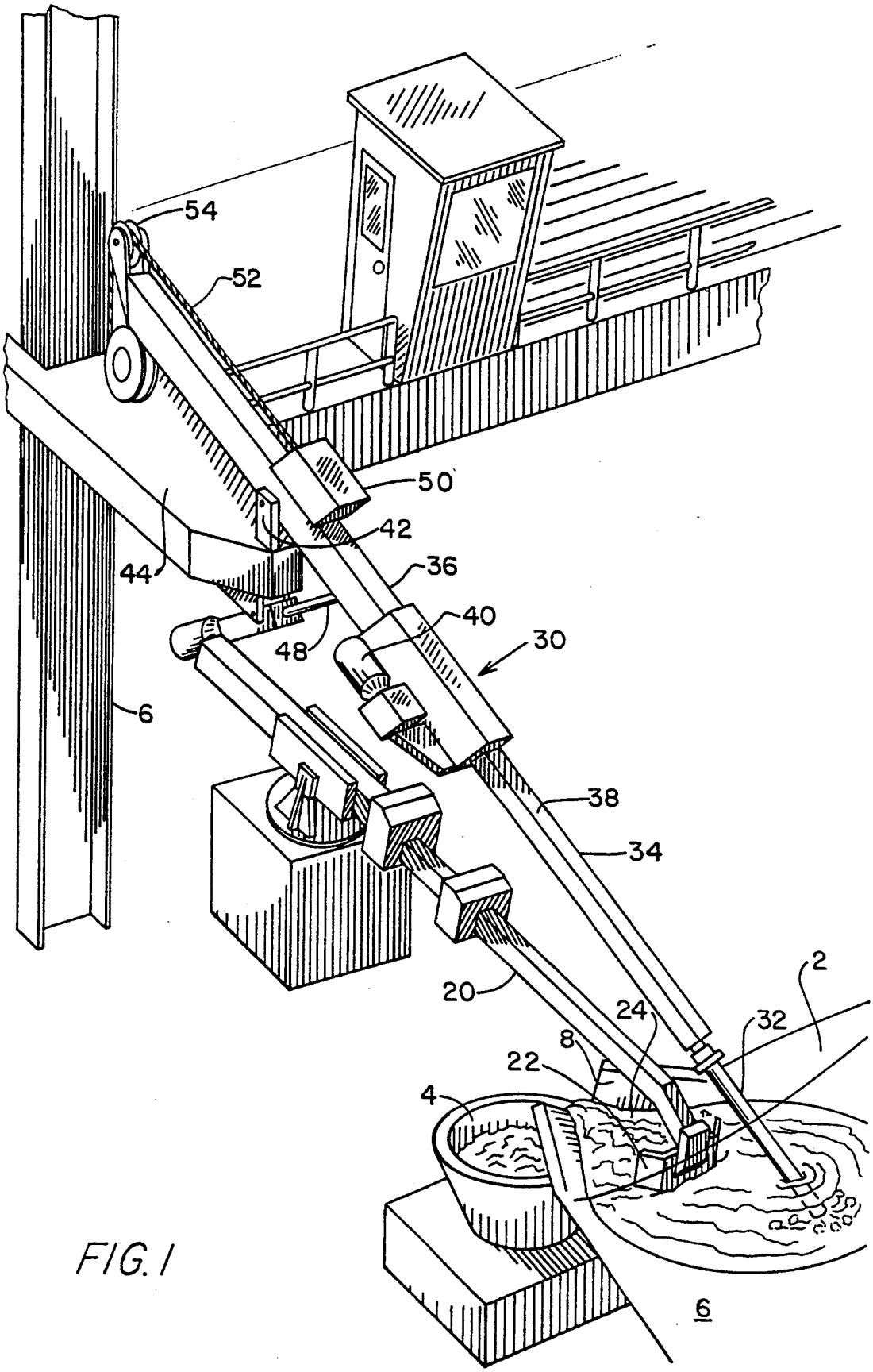
FIG. 1 is a view of the apparatus for removing slag from the surface of a body of molten metal in accordance with the invention.
Figure 3:
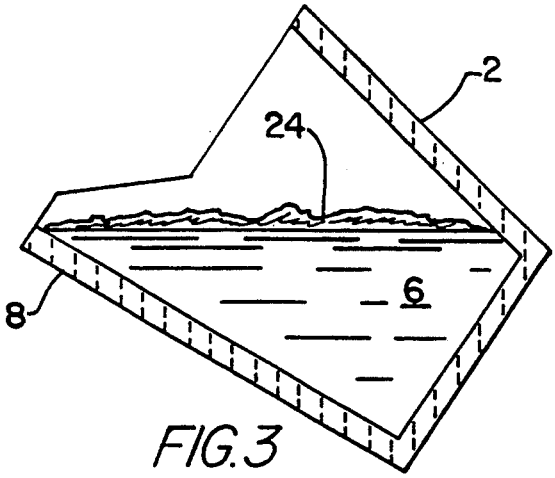
FIG. 3 is a side view of a crucible showing the uniform distribution of slag over the surface of molten metal.

In the making of steel, the body of molten metal is subjected to refining steps such as desulfurization to remove contaminants from the metal. The refining steps result in a layer of slag or dross accumulating on the surface of the molten metal. To improve the quality of the metal, it is desirable to remove the slag to a very low level. Referring now to FIG. 1, there is shown an embodiment in accordance with the present invention for ensuring the efficient and safe removal of such slag. Thus, there is shown crucible 2 and slag pot 4, the crucible containing molten metal 6. The crucible has a spout 8 tipped towards the slag pot. A rake generally referred to as 20 is provided projecting into crucible 2. Rake 20 has a scraper 22 immersed in slag 24 sitting on top of molten metal 6. As will be seen in FIG. 3, the slag layer can extend across the extent of the surface of crucible 2.

Figure 2:
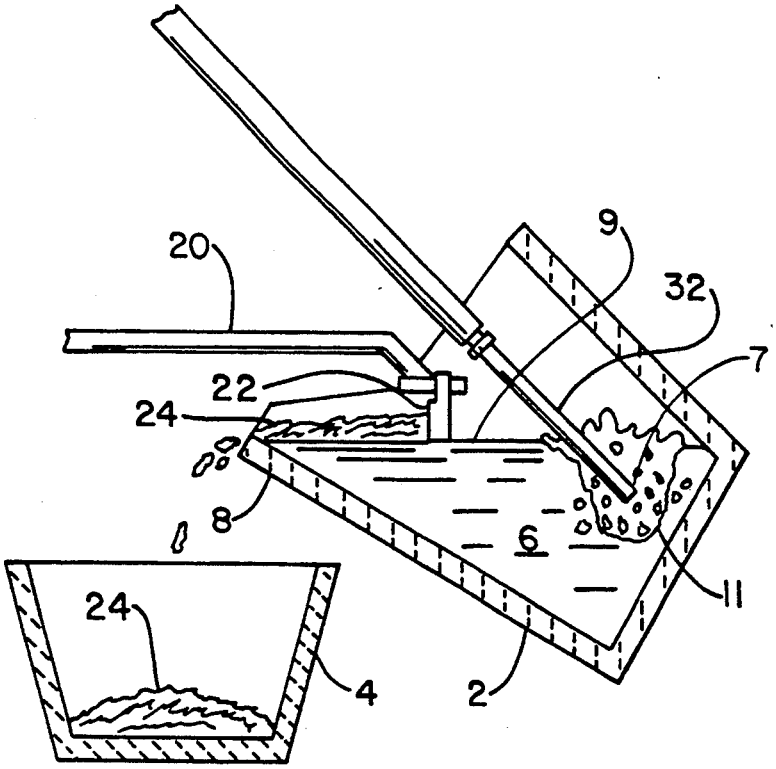
FIG. 2 is a side view of a crucible containing molten metal having a layer of slag and having a lance for injecting gas into the molten metal.

In FIGS. 1 and 2, there is shown an apparatus 30 for injecting gas into the molten metal in accordance with the invention. Apparatus 30 comprises a hollow lance 32 securely mounted on an arm member 34. A hose (not shown) is provided inside arm 34 and is connected to a source of gas for delivery to crucible 2. Arm member 34 is comprised of upper section 36 and lower section 38. For purposes of the invention, it is preferred that lower arm 38 is telescopically attached to upper arm 36. Thus, lower arm 38 can be advanced into crucible 2 or can be made to recede from crucible 2 by an electric motor 40. From FIG. 1, it will be seen that arm 34 is mounted on a pivot point 42 that permits arm 34 and particularly lance 32 to be moved upwardly or downwardly or from side to side. Pivot point 42 is mounted on member 44 that in turn is mounted on upright 46. A hydraulic arm 48 is mounted under member 44 for purposes of moving arm 34 upwards and downwards, for example.

A counterbalance weight 50 is provided or located on upper arm 36. Counterbalance weight 50 is attached by cable 52 to lower arm 38. That is, cable 52 extends around pulley 54 and then is connected to the end (not shown) of lower arm 38. Counterbalance weight 50 is effective in retracting or withdrawing lower arm 38 and lance 32 from molten metal 6 in crucible 2 in the event that a power failure is experienced during processing. That is, counterbalance weight 50 has sufficient weight to be capable of withdrawing lower arm 34 into upper arm 36 in the event of an electric power failure. This has the advantage of retracting lower arm 34 from crucible 2 allowing the crucible to be moved to the next steel-making station without interruption.

In FIGS. 1 and 2, it will be seen that blade 22 of rake 20 is positioned to pull slag from the surface of molten metal 6 in crucible 2 into slag pot 4. In conventional processing, slag 24 in molten metal 6 (FIG. 3) assumes a more or less uniform layer. Removal of slag from such a container results in the removal of molten metal, e.g., molten iron, into the slag pot which results in a loss of molten metal. Additionally, however, rake 20 is not effective in removing substantially all of the slag, and this can result in poor quality metal. For example, as noted, as much as 15 to 25% of the slag present in the layer of slag 24 can remain even after extensive raking.

Figure 4:
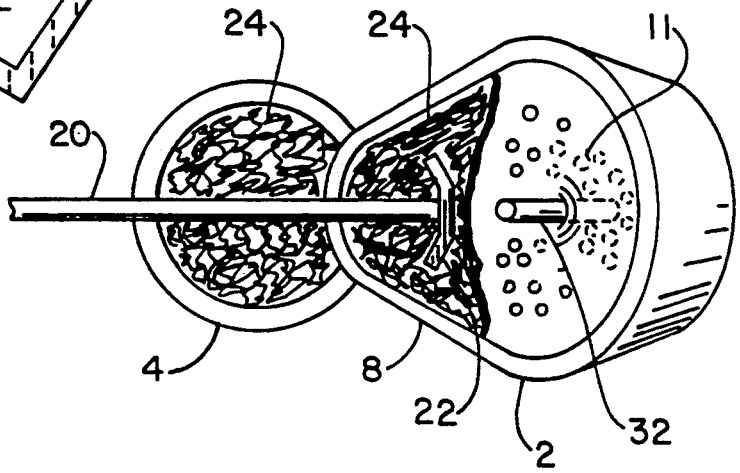
FIG. 4 is a top view of the crucible and slag pot, illustrating concentrations of slag towards the spout of the crucible.

In the present invention, it has been discovered that injecting gas through lance 32 into molten metal 6 concentrates slag 24 in the area adjacent spout 8 which greatly facilitates removal of slag 24, as shown in FIGS. 2 and 4. Injecting gas through lance 32 has the effect of pushing the slag towards spout 8 as bubbles of gas 11 rise from the melt to the surface 9. Preferably, end 7 of lance 32 is immersed below surface 9 of molten metal 6 in the range of about 3 to 20 inches. End 7 may be immersed further, but it is presently believed that this does not greatly benefit the removal of slag. Further, as will be seen from FIGS. 2 and 4, lance 32 should be immersed so as to inject gas in the area of the surface opposed from the area of the surface which is subject to raking. This has the effect of moving slag from the area of the surface away from the spout and pushing or concentrating it adjacent the spout. Thus, injecting gas in this manner provides a substantial area of the surface of the molten metal away from spout 8 that is substantially free of slag. Accordingly, a large area of the surface of molten metal is substantially free of slag, as illustrated in FIG. 4. This results in the slag being concentrated on the remainder of the surface and adjacent the pouring spout and facilitates its removal.

The gas that may be used is any inert gas such as helium, neon, argon, krypton, xenon, nitrogen and carbon dioxide. Also, reactive gases may be used if it is desired to perform a fluxing operation simultaneously. The preferred gas for use with molten iron is nitrogen gas. The gas can be flowed into the molten metal at a rate of 20 to 200 SCFM, preferably 50 to 100 SCFM, with a typical flow rate being about 75 SCFM. For these flow rates, the gas can be maintained at a pressure in the range of about 50 to 200 psi with a typical pressure being about 90 psi. When operated in this manner, the process and apparatus can remove 95% and typically more than 98% of the slag layer from the surface of the molten metal. This has the advantage that a higher quality metal is obtained.

The lance can be fabricated from any material which will withstand the temperatures of the melt. For molten iron, the lance can be fabricated from steel having a refractory coating resistant to the molten iron such as a coating of alumina thereon. Lances which have been found suitable for molten iron can be obtained from Rossborough or Inland Refractories.

This method and apparatus may be used with any molten metal where it is desired to remove slag or dross from the surface thereof. For example, this invention may be used with molten metals such as iron, steel, copper magnesium, aluminum and other primary metals.

While the invention has been described in terms of preferred embodiments, the claims appended hereto are intended to encompass other embodiments which fall within the spirit of the invention.

What is claimed is:

1. A telescoping boom and lance for injecting inert gas into a body of molten iron having a slag layer on a surface thereof, the body contained in a crucible having a side thereof for removing said slag therefrom, the lance capable of injecting the inert gas through an area of the surface opposed from the side thereof for removing the slag, the telescoping boom comprising:

(a) a first section in telescoping relationship with a second section, the first section having said lance fastened thereto; and (b) a counterbalance weight mounted on said second section in communication with said first section, the counterbalance weight capable of retracting said first section and said lance from said molten iron upon an electric power failure.

* * * * *